US007726990B2

(12) United States Patent
Wang et al.

(10) Patent No.: US 7,726,990 B2
(45) Date of Patent: Jun. 1, 2010

(54) ELECTRICAL CONNECTOR HAVING IMPROVED TERMINAL SWITCH ARRANGEMENT

(75) Inventors: Chen-Xi Wang, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,730

(22) Filed: Jun. 30, 2008

(65) Prior Publication Data

US 2009/0011629 A1 Jan. 8, 2009

(30) Foreign Application Priority Data

Jul. 3, 2007 (CN) ..... 2007 2 0040513 U

(51) Int. Cl.
*H01R 29/00* (2006.01)

(52) U.S. Cl. ..... 439/188; 439/675; 200/51.09

(58) Field of Classification Search ..... 439/188, 439/668, 675, 924.1, 944; 200/51.09
See application file for complete search history.

(56) References Cited

U.S. PATENT DOCUMENTS 4,426,558 A * 1/1984 Tanaka et al. ..... 200/51.09
4,937,404 A * 6/1990 Kitagawa ..... 200/51.09
6,244,905 B1 6/2001 Wang
6,270,380 B1 * 8/2001 Shichida et al. ..... 439/669
6,382,999 B1 * 5/2002 Mou et al. ..... 439/188
6,923,687 B2 8/2005 Wang
7,094,088 B2 8/2006 Wang et al.
2002/0052148 A1 * 5/2002 Nagata ..... 439/668

* cited by examiner

*Primary Examiner*—Edwin A. Leon
*Assistant Examiner*—Vanessa Girardi
(74) *Attorney, Agent, or Firm*—Wei Te Chung; Andrew C. Cheng; Ming Chieh Chang

(57) ABSTRACT

An electrical connector (100) includes an insulative housing (10) defining a receiving hole for accommodating a mating plug, a first set of and a second set of switch terminals (21, 22, 23, 24, 25), and a flexible terminal (27) positioned between the switch terminals (21, 22, 23, 24, 25). The flexible terminal (27) has a retaining portion (270), a flexible arm (271) bent from the retaining portion (270) and a contact portion (275) formed on the flexible arm (271). The switch terminals (21, 22, 23, 24, 25) abut against the plug in a left-to-right direction. The flexible terminal (27) abuts against the mating plug in an up-to-down direction to provide a great insertion force in order to reach a good inserting or pulling feeling of the mating plug.

12 Claims, 5 Drawing Sheets

ELECTRICAL CONNECTOR HAVING IMPROVED TERMINAL SWITCH ARRANGEMENT

BACKGROUND OF THE INVENTION

1. Field of the Invention

The present invention generally relates to an electrical connector, and particularly relates to an electrical connector having improved terminal arrangement thereof.

2. Description of Related Art

Electrical connector is usually required to have good inserting or pulling feeling of a mating plug. The electrical connector includes an insulative housing and a terminal retained on one side portion of the insulative housing. The insulative housing defines a receiving hole for receiving a mating plug therein. The terminal includes a retaining portion retained in the insuative housing and a contact portion extending from a front end of the retaining portion. The contact portion extends into the receiving hole for pressing against the mating plug in a left-to-right direction and forming an electrical connection therebetween. The terminal is simple and dose not have any structure for pressing against the mating plug in an up-to-down direction, thus the inserting or pulling feeling of the mating plug is not good enough.

Another electrical connector of prior art includes an insulative housing and a flexible terminal retained on a rear end portion of the insulative housing. The insulative housing defines a receiving hole for receiving a mating plug. The flexible terminal concludes a retaining portion, two separated flexible portions extending from an upper and a lower end of the base portion. Two flexible portions clamp the mating plug together with great press and a good handle feeling while the mating plug is inserted into the receiving hole. However, the flexible terminal has a complicated structure, thereby resulting in a complicate manufacturing and increasing the production cost of the electrical connector.

Hence, it is desirable to have an improved electrical connector to overcome the above-mentioned disadvantages of the related art.

SUMMARY OF THE INVENTION

According to one aspect of the present invention, an electrical connector includes an insulative housing defining a receiving hole for accommodating a mating plug, a first set of and a second set of switch terminals retained in the insulative housing, and a flexible terminal retained on a rear end of the insulative housing and located between the switch terminals along a left-to-right direction. The flexible terminal includes a retaining portion retained in the insulative housing and a contact portion extending into the receiving hole. The contact portion of the flexible terminal is positioned above the retaining portion.

According to another aspect of the present invention, an electrical connector includes an insulative housing, a first set of switch terminals, a second set of switch terminals, and a flexible terminal. The insulative housing defines a plurality of first type grooves, a second type groove, and a receiving hole for accommodating a mating plug. The first set of and the second set of switch terminals are retained in the first type grooves extending in a vertical direction. The flexible terminal is retained in the second type groove extending in a horizontal direction. The flexible terminal includes a contact portion extending into the receiving hole and being located on a rear side thereof.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE PREFERRED EMBODIMENT

Figure 1:
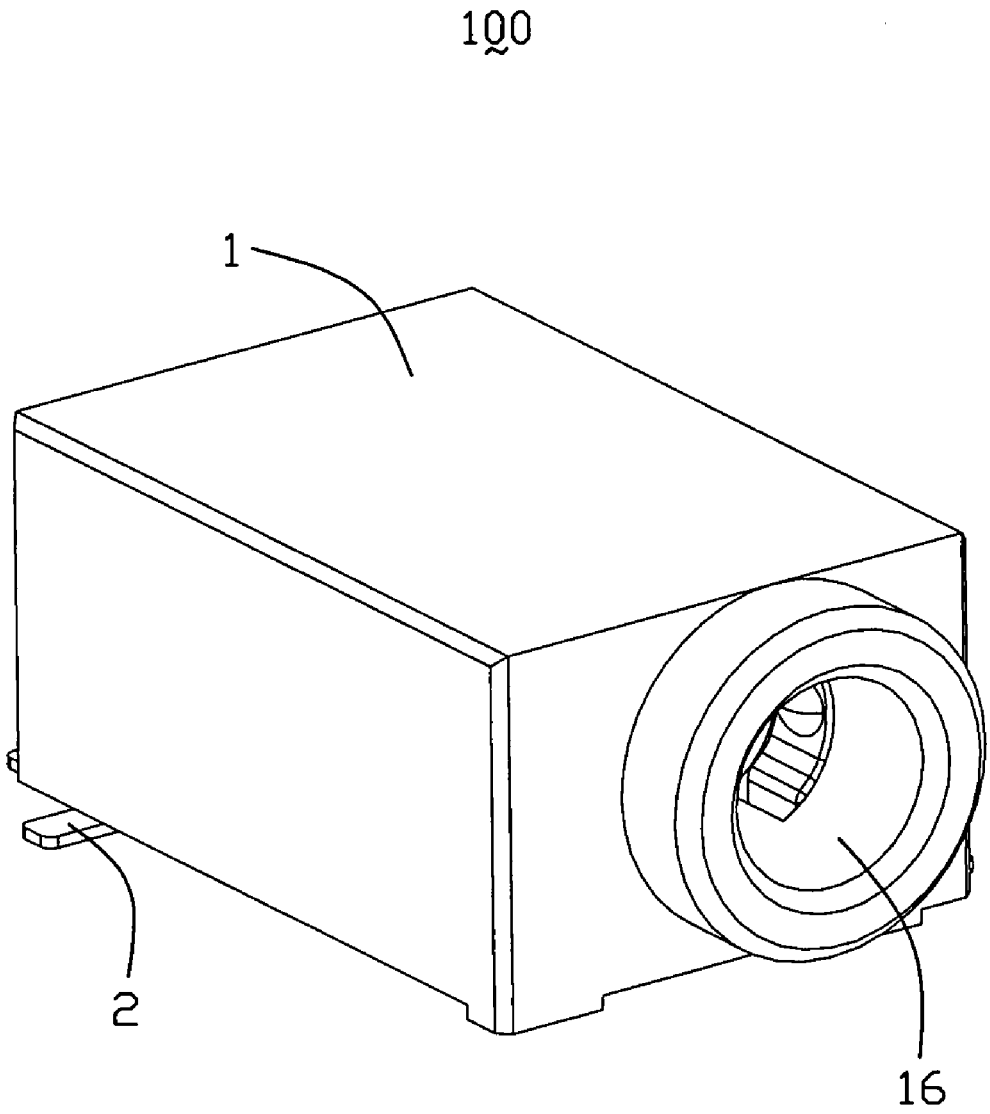
FIG. 1 is a front perspective view of an electrical connector according to a preferred embodiment of the present invention.
Figure 2:
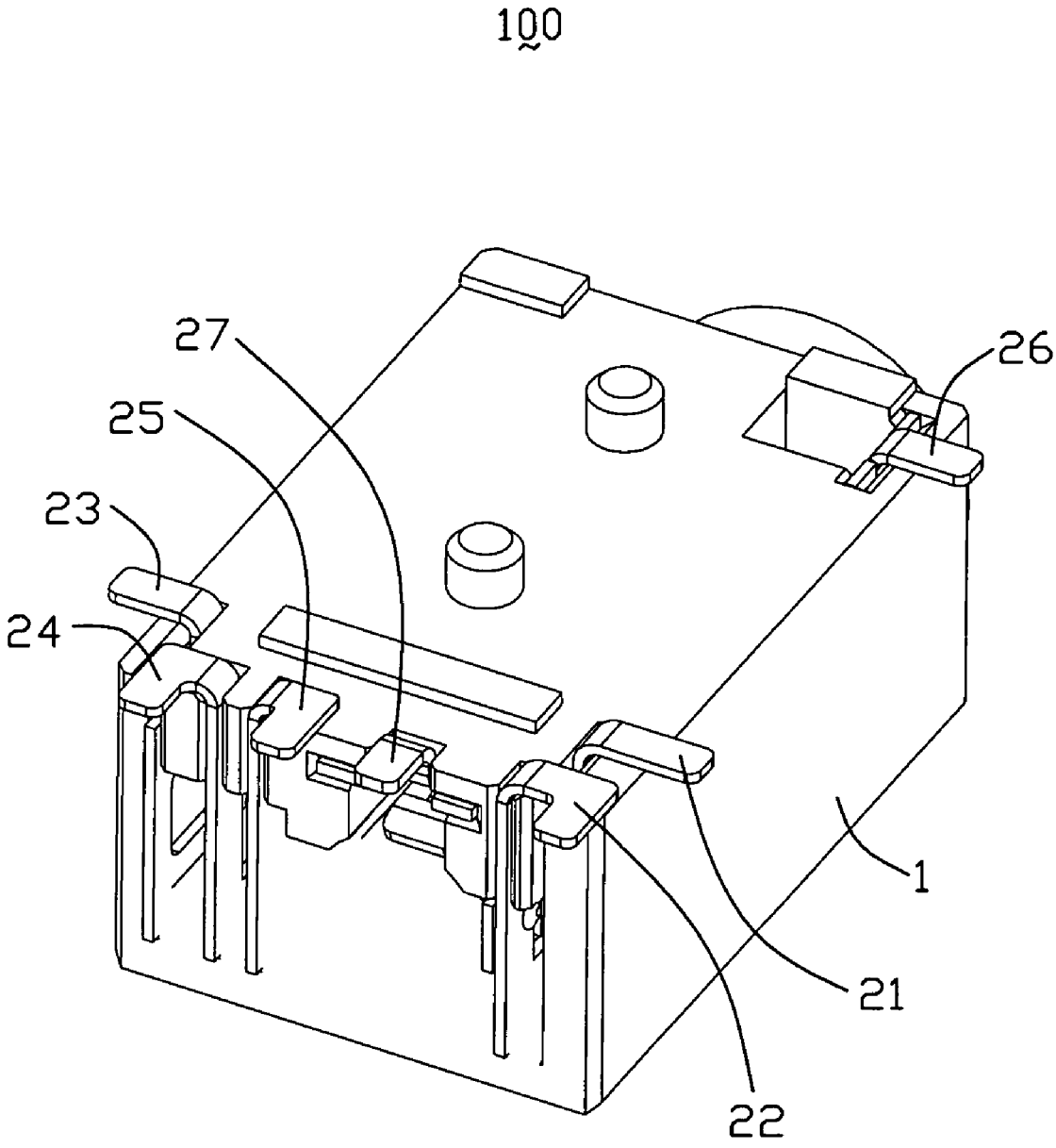
FIG. 2 is a rear perspective view of the electrical connector of FIG. 1.

Reference will now be made to the drawing figures to describe the present invention in detail.

With reference to FIGS. 1-5, an electrical connector 100 in accordance with the present invention for electrically connecting a mating plug (not shown) includes an insulative housing 1 and a plurality of conductive terminals 2 retained in the insulative housing 1. The terminals 2 are composed of a first set of and a second set of switch terminals, a sixth terminal 26 and a flexible terminal 27. The first set of switch terminals include a first terminal 21 and a second terminal 22 mating with the first terminal 21. The second set of switch terminals include a third terminals 23, a fourth terminal 24 mating with the third terminal 23, and a fifth terminal 25 abutting against the third terminal 23.

The insulative housing 1 is of lengthways shape and has a cuboid main body 10, a cylindered project portion 15 protruding from the main body 10, and a receiving hole 16 extending through the main body 10 and the project portion 15 in a lengthwise direction thereof. The receiving hole 16 is defined for accommodating the mating plug. The main body 10 defines a top portion 11, a bottom portion 12 and a pair of side portions 13 connected to the top portion 10 and the bottom portion 12. The insulative housing 1 includes a first groove 121, a second groove 122, a third groove 123, a fourth groove 124, a fifth groove 125, a sixth groove 126, and seventh groove 127 which are all disposed at two sides of the receiving hole 16 except for the seventh groove 127. The seventh groove 127 is formed under the receiving hole 16. The sixth groove 126 is formed on a front side of the main body 10. In other words, all the grooves 121, 122, 123, 124, 125, 126, 127 communicating with the receiving hole 16 and run through the bottom portion 12. The grooves 121, 122, 123, 124, 125, 126 extend in an vertical direction except for the seventh groove 127 which extends in a horizontal direction. The bottom portion 12 further defines a plurality of projecting posts 128, 129 to mount the electrical connector 100 onto a printed circuit board.

All the terminals 2 are made of conductive material. Each terminal 21, 23, 24, 25, 26, 27 respectively defines a retaining portion 210, 220, 230, 240, 250, 260, 270 and a soldering portion 216, 226, 236, 246, 256, 266, 276 extending beyond the bottom portion 12 of the insulative housing 1 for mounting to the printed circuit board. Each terminal 21, 23, 25, 26, 27 respectively defines a flexible arm 211, 231, 251, 261, 271 bent from the retaining portion 210, 230,250, 260. The first terminal 21 and the third terminal 23 further have an insulator 215, 235 coupled to the flexible arm 211, 231. The fifth terminal 25 and the flexible terminal 27 respectively defines a contact portion 255, 275 formed on the flexible arm 251, 271, the contact portion 275 is positioned above the retaining portion 270. The fifth terminal 25 has an abutting portion 257 positioned on a front end of the flexible arm 251. The first terminal 21 has a mating portion 212 positioned on the end of the flexible arm 211 and adjacent to the insulator 215. The second terminal 22 forms a emboss 225 positioned on the inner of the retaining portion 210 to contact with the mating portion 212 of the first terminal 21. The fourth terminal 24 has a mating portion 241 extending forwardly from the retaining portion 240, the mating portion 241 is defined to mate with the flexible arm 231 of the third terminal 23. The sixth terminal 26 includes an emboss 265 positioned in a middle portion of the flexible arm 261.

Referring to FIGS. 1-5, in assembly, firstly, the terminals 2 except for the sixth terminal 26 are inserted into corresponding grooves 121, 122, 123, 124, 125, 127 from a rear end of the insulative housing 1. The first terminal 21 and the second terminal 22 are assembled together. The third terminal 23, the fourth terminal 24 and the fifth terminal 25 are assembled together as well. In other words, the first terminal 21 is positioned on an outer side of the second terminal 22, the fifth terminal 25 positioned inside of the third terminal 23, and the fourth terminal 24 is positioned between the terminals 23, 25. The mating portion 241 of the fourth terminal 24 contacts the flexible arm 231 of the third terminal 23. The insulator 215, 235 and the contact portion 255, 275 respectively protrudes into the receiving hole 16 for mating with the mating plug. The contact potion 275 is positioned under the insulator 215 of the first terminal 21 for mating the mating plug at a same time. In other words, the insulator 215 of the first terminal 21 and the contact portion 275 of the flexible terminal 27 are behind the contact potion 255 of the fifth terminal 25. Finally, the sixth terminal 26 is inserted into the sixth groove 126 from the bottom potion 12 of the insulative housing 1, the emboss 265 protruding into the receiving hole 16. The sixth terminal 26 is positioned in the front of other terminals 21, 22, 23, 24, 25, 27 and close to the project portion 15 of the insulative housing 1.

Figure 3:
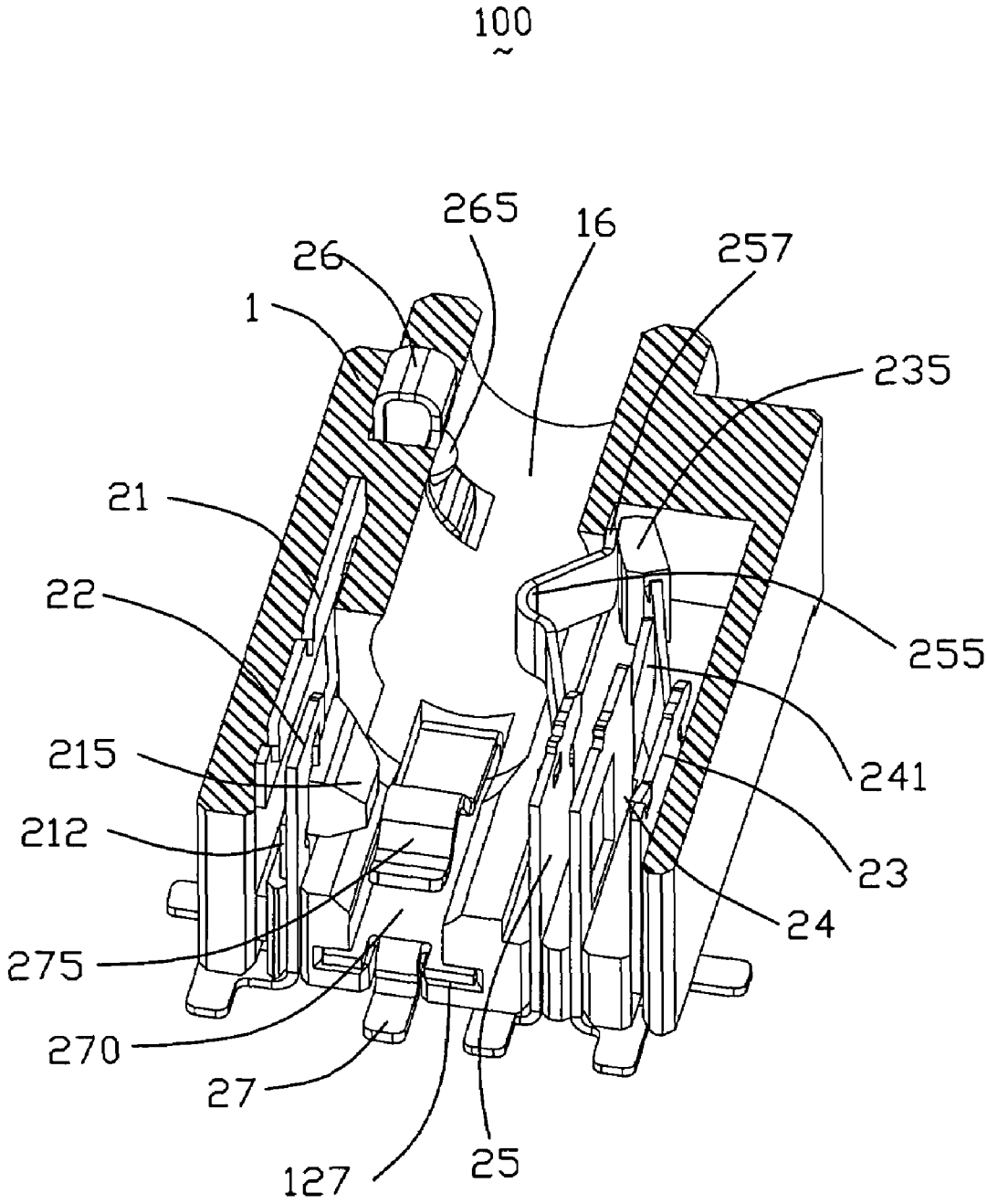
FIG. 3 is a perspective view of the electrical connector of FIG. 1 with its top portion partially cut away to reveal terminal arrangement.
Figure 4:
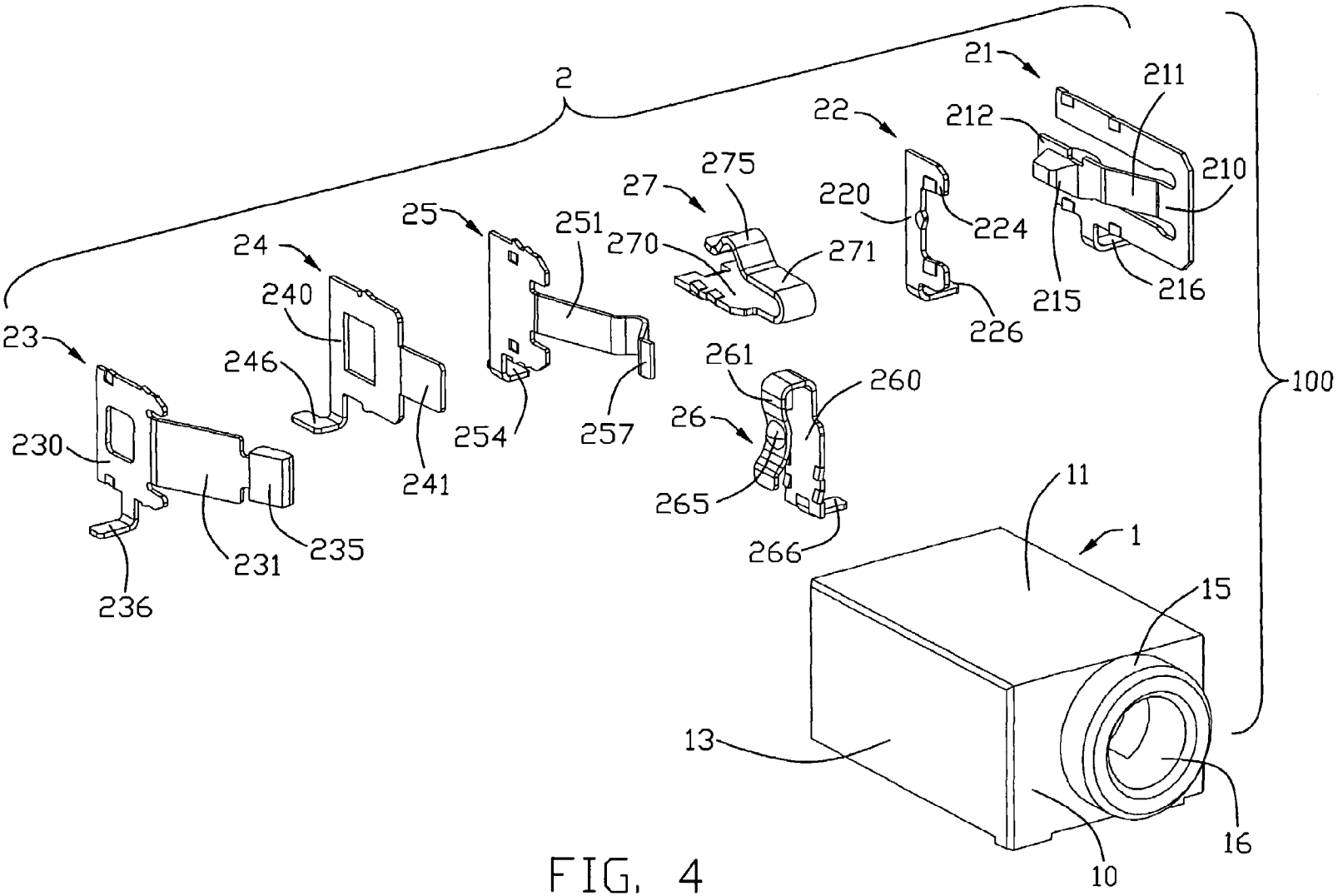
FIG. 4 is an exploded perspective view of the electrical connector of FIG. 1.
Figure 5:
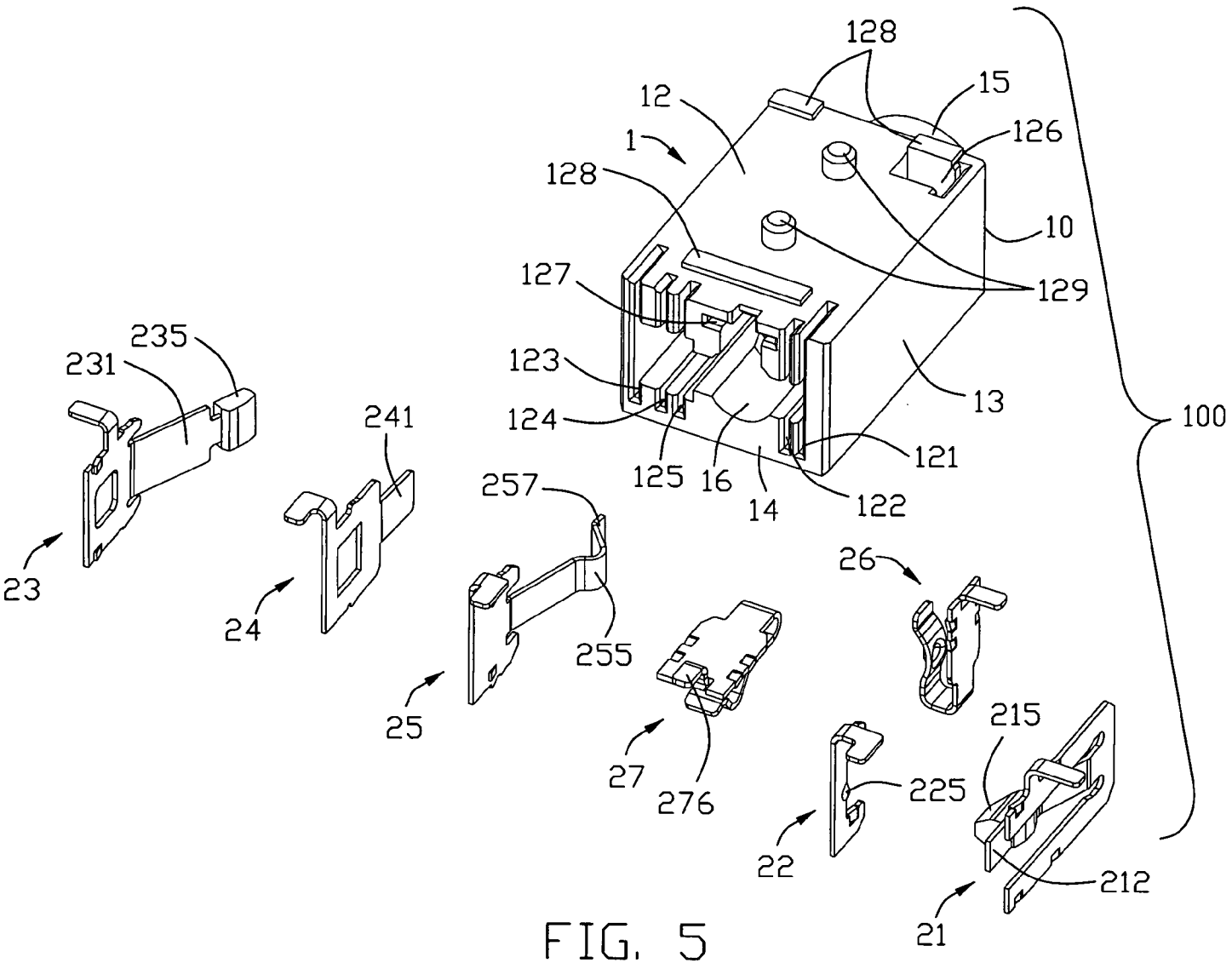
FIG. 5 is an another exploded perspective view of the electrical connector of FIG. 1.

Referring to the FIG. 3, The sixth terminal 26 is closer to the project portion 15 of the insulative housing 1 than other terminals 21, 22, 23, 24, 25 and 27. The first set of switch terminals and the flexible terminal 27 is located behind of the second set of switch terminals, and the flexible terminal 27 located between the switch terminals in a left-to-right direction. The contact portion 275 of the flexible terminal 27 is positioned under the insulator 215 of the first terminal 21 and offset from the insulator 275 as well, thus the contact portion 275 and the insulator 215 could contact the matting plug at a same time. The terminal 24, 25 and 26 are arranged from inner to outside of the insulative housing 1.

Taking reference to FIG. 3, While the mating plug is inserted into the receiving hole 16 of the electrical connector 100. Firstly, the mating plug contacts the emboss 265 of the sixth terminal 26. While the mating plug is further inserted, the mating plug abuts against the contact portion 255 of the fifth terminal 25 in order to force the abutting portion 257 to abut against the insulator 235 of the third terminal 23 to make the fourth terminal 24 disengage from the third terminal 23 to reach a switch function. While the mating plug is kept inserting, the mating plug contacts the insulator 215 of the first terminal 2 and the contact portion 275 of the flexible terminal 27 at a same time the mating portion 212 moves outwardly to lose contact with the emboss 225 of the second terminal 22, thereby achieving an anther switch function.

When the mating plug is inserted into the electrical connector 100 fully, the two switch terminals 21, 25 abut against the mating plug in a left-to-right direction. Besides, the flexible terminal 27 abuts against the mating plug in an up-to-down direction to provide a great insertion force in order to reach a good handle feeling.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing defining a receiving hole extending in an axial direction inwardly from a front mating face of the housing;

a pair of contact sets respectively located by two opposite lateral sides of said receiving hole; said pair of contact sets defining opposite contacting sections extending into the receiving hole in opposite lateral directions; and an auxiliary contact located by one of top and bottom sides of the receiving hole with a contacting region extending into the receiving hole in a vertical direction; wherein at least one of said pair of contact sets includes two pieces electrically functioning as a switch with a contact portion extending into the receiving hole in a radial direction, while the auxiliary contact performs a click effect for manual operation feeling; wherein a distance between the front mating face and the contacting region of the auxiliary contact is not less than that between the front mating face and the contact portion of the at least one of said pair of contact sets.

2. The electrical connector as claimed in claim 1, wherein the other of said pair of contact sets also includes two pieces electrically functioning as another switch, and the contacting sections of said pair of contact sets are spaced from each other with the contacting region therebetween in said axial direction.

3. The electrical connector as claimed in claim 1, wherein said auxiliary contact is located on a rear portion of the housing.

4. The electrical connector as claimed in claim 1, wherein said auxiliary contact defines a horizontal U-shaped structure assembled to the housing forwardly from a rear face of the housing.

5. The electrical connector as claimed in claim 4, wherein said horizontally U-shaped structure defines a lower retaining portion and an upper flexible arm linked by a bight, said bight being located at a front end thereof.

6. The electrical connector as claimed in claim 5, wherein said auxiliary contact is located by the bottom side of the receiving hole, and the lower retaining portion is equipped with a solder tail and the upper flexible arm is equipped with said contacting region.

7. An electrical connector comprising:

an insulative housing defining a receiving hole for accommodating a mating plug;

a first set of and a second set of switch terminals retained in the insulative housing; and a flexible terminal retained on a rear end of the insulative housing and located between the switch terminals; wherein the flexible terminal includes a retaining portion retained in the insulative housing and a contact portion extending into the receiving hole; and wherein the contact portion of the flexible terminal is positioned above the retaining portion, the first set of switch terminals includes a first moveable terminal and a second unmovable terminal mating with the first moveable terminal, the first moveable terminal defines a first flexible arm with a first insulator attached to the first flexible arm, and the contact portion of the flexible terminal and the first insulator are configured to contact with the mating plug along a lateral direction and a vertical direction respectively;

wherein the second set of switch terminals contain a third terminal, a fourth terminal for mating with the third terminal and a fifth terminal to deflect the third terminal outwardly to deviate from the fourth terminal in condition that the fifth terminal is in contact with the mating plug.

8. The electrical connector as claimed in claim 7, wherein the flexible terminal is disposed under the first flexible arm of the first moveable terminal along the vertical direction.

9. The electrical connector as claimed in claim 7, wherein the insulative housing defines a groove being formed on a bottom portion thereof and extending along a rear-to-front direction thereof to receive the flexible terminal.

10. The electrical connector as claimed in claim 7, wherein the flexible terminal further includes a flexible arm bent rearwardly from a front end of the retaining portion, and the contact portion is formed on the flexible arm.

11. The electrical connector as claimed in claim 7, wherein the third terminal defines a retaining portion retained in the insulative housing, a flexible arm bent from the retaining portion and a second insulator coupled to the flexible arm, and the fourth terminal further has a mating portion to mate with the flexible arm of the third terminal.

12. The electrical connector as claimed in claim 7, wherein the insulative housing includes a main body and a project portion protruding from the main body, the receiving hole extends through the main body and the project portion, the electrical connector further includes a R-shaped sixth terminal retained on a front side of the switch terminals and the flexible terminal, and the sixth terminal has a flexible arm with a emboss projecting into the receiving hole as well.

* * * * *